US010854126B1

(12) United States Patent
Liao et al.

(10) Patent No.: US 10,854,126 B1
(45) Date of Patent: Dec. 1, 2020

(54) DISPLAY DEVICE AND VCOM SIGNAL GENERATION CIRCUIT

(71) Applicant: AU OPTRONICS CORP., Hsin-Chu (TW)

(72) Inventors: Wei-Chien Liao, Hsin-Chu (TW); Meng-Chieh Tsai, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 0 days.

(21) Appl. No.: 16/663,893

(22) Filed: Oct. 25, 2019

(30) Foreign Application Priority Data

May 23, 2019 (TW) ..... 108117903 A

(51) Int. Cl.
*G09G 3/20* (2006.01)

(52) U.S. Cl.
CPC ..... *G09G 3/20* (2013.01); *G09G 2310/0275* (2013.01)

(58) Field of Classification Search
CPC ..... G09G 3/20; G09G 2310/0275
See application file for complete search history.

(56) References Cited

U.S. PATENT DOCUMENTS 7,167,154 B2 * 1/2007 Sato ..... G09G 3/3677 345/100
2010/0073341 A1 * 3/2010 Toyooka ..... G09G 3/3614 345/208
2010/0182292 A1 * 7/2010 Kouno ..... G09G 3/3655 345/205
2011/0128272 A1 * 6/2011 Chen ..... G09G 3/3655 345/211
2012/0068991 A1 * 3/2012 Watsuda ..... G09G 3/3648 345/212
2012/0075259 A1 * 3/2012 Chung ..... G09G 3/3266 345/204

(Continued)

FOREIGN PATENT DOCUMENTS

CN 101783121 A 7/2010
CN 101676987 B 8/2014
CN 108630161 A 10/2018

(Continued)

OTHER PUBLICATIONS

Office action issued by TIPO dated Feb. 4, 2020.

*Primary Examiner* — Amare Mengistu
*Assistant Examiner* — Jennifer L Zubajlo
(74) *Attorney, Agent, or Firm* — WPAT, PC

(57) ABSTRACT

A display device comprises a plurality of pixel unit sets and a plurality of common electrode (VCOM) signal generation circuits. Each of the pixel unit sets comprises a first portion pixel unit and a second portion pixel unit. Each of the first portion pixel unit and each of the second portion pixel unit comprise a plurality rows of pixel units. Each row of the pixel units comprises a plurality of pixel units. The VCOM signal generation circuits are respectively coupled to one of the pixel unit sets. The VCOM signal generation circuits are divided into a plurality of groups of number m. The VCOM signal generation circuits in each of the groups generate a first VCOM signal and a second VCOM signal to the coupled pixel unit set according to a first clock signal, a second clock signal and one of a plurality control signal sets of number m.

9 Claims, 5 Drawing Sheets

(56) References Cited

U.S. PATENT DOCUMENTS

| | | | | |
|---|---|---|---|---|
| 2016/0027387 | A1* | 1/2016 | Park | G09G 3/3611<br>345/691 |
| 2018/0286332 | A1* | 10/2018 | Ma | G09G 3/3614 |

FOREIGN PATENT DOCUMENTS

| | | | |
|---|---|---|---|
| CN | 108847175 | A | 11/2018 |
| CN | 109817151 | A | 5/2019 |

* cited by examiner

DISPLAY DEVICE AND VCOM SIGNAL GENERATION CIRCUIT

This application claims the benefit of Taiwan application Serial No. 108117903, filed May 23, 2019, the subject matter of which is incorporated herein by reference.

BACKGROUND OF THE INVENTION

Field of the Invention

The invention relates to a display device and a VCOM signal generation circuit.

Description of the Related Art

Display devices are widely applied to a variety of electronic products such as notebook computers, smart phones, tablets. In addition to the requirement of specification and performance, users may expect to have privacy on their display devices and prevent others from peeping at the viewing screen. In view of the above requirement, to provide a display device having privacy protection function is a target of the industry.

SUMMARY OF THE INVENTION

An aspect of the present invention discloses a display device. The display device comprises a plurality of pixel unit sets and a plurality of common electrode (VCOM) signal generation circuits. Each of the pixel unit sets comprises a first portion pixel unit and a second portion pixel unit. Each of the first portion pixel unit and each of the second portion pixel unit comprise a plurality rows of pixel units. Each row of the pixel units comprises a plurality of pixel units. The VCOM signal generation circuits are respectively coupled to one of the pixel unit sets. The VCOM signal generation circuits are divided into a plurality of groups of number m. The VCOM signal generation circuits in each of the groups generate a first VCOM signal and a second VCOM signal to the coupled pixel unit set according to a first clock signal, a second clock signal and one of a plurality control signal sets of number m.

Another aspect of the present invention discloses a common electrode (VCOM) signal generation circuit for display devices. The VCOM signal generation circuit comprises a first transistor, a second transistor, a third transistor, a fourth transistor, a fifth transistor, a sixth transistor, a seventh transistor, an eighth transistor, a ninth transistor, a tenth transistor, an eleventh transistor, a twelfth transistor, a thirteenth transistor, a fourteenth transistor, a fifteenth transistor, a sixteenth transistor, a seventeenth transistor, an eighteenth transistor, a nineteenth transistor, a twentieth transistor, a first capacitor, a second capacitor and a third capacitor. Wherein a first node of the first transistor receives a first shift signal corresponding to the beginning of a pixel data writing time of a pixel unit set coupled to each of the VCOM signal generation circuits output by a shift register, a gate node of the first transistor receives a gate driving circuit a first driving signal corresponding to the first shift signal, a first node of the second transistor is coupled to a first voltage, a gate node of the second transistor receives a second shift signal corresponding to the ending of the pixel data writing time of the pixel unit set coupled to each of the VCOM signal generation circuits output by the shift register, a second node of the second transistor is coupled to a second node of the first transistor, a first node of the third transistor receives the first clock signal, a gate node of the third transistor receives a second driving signal corresponding to the second shift signal output by the gate driving circuit, a first node of the fourth transistor is coupled to a second voltage, a gate node of the fourth transistor is coupled to the second node of the first transistor, a second node of the fourth transistor is coupled to a second node of the third transistor, a first node of the fifth transistor is coupled to the first voltage, a gate node of the fifth transistor is coupled to a signal, a second node of the fifth transistor is coupled to the second node of the third transistor, a first node of the sixth transistor is coupled to a third voltage, a gate node of the sixth transistor is coupled to the second node of the third transistor, a second node of the sixth transistor is configured to output the first VCOM signal, a first node of the seventh transistor is coupled to the first voltage, a gate node of the seventh transistor receives a first control signal of the corresponding control signal set, a second node of the seventh transistor is coupled to the second node of the third transistor, a first node of the eighth transistor is coupled to a fourth voltage, a gate node of the eighth transistor receives a second control signal of the corresponding control signal set, a second node of the eighth transistor is coupled to the second node of the third transistor, a first node of the ninth transistor is coupled to a fifth voltage, a gate node of the ninth transistor is coupled to the second node of the third transistor, a second node of the ninth transistor is configured to output the second VCOM signal, a first node of the tenth transistor is coupled to a sixth voltage, a gate node of the tenth transistor is coupled to the second node of the first transistor, a second node of the tenth transistor is coupled to the second node of the sixth transistor, a first node of the eleventh transistor is coupled to the third voltage, a gate node of the eleventh transistor is coupled to the second node of the first transistor, a first node of the twelfth transistor receives the second clock signal, a gate node of the twelfth transistor receives the second driving signal, a second node of the twelfth transistor is coupled to a second node of the eleventh transistor, a first node of the thirteenth transistor is coupled to the second node of the eleventh transistor, a gate node of the thirteenth transistor receives the signal, a second node of the thirteenth transistor is coupled to the first voltage, a first node of the fourteenth transistor is coupled to the first node of the tenth transistor, a gate node of the fourteenth transistor receives the signal, a second node of the fourteenth transistor is coupled to the second node of the sixth transistor, a first node of the fifteenth transistor is coupled to the second node of the sixth transistor, a gate node of the fifteenth transistor is coupled to the second node of the eleventh transistor, a second node of the fifteenth transistor is coupled to the fifth voltage, a first node of the sixteenth transistor is coupled to the second node of the eleventh transistor, a gate node of the sixteenth transistor receives the second control signal of the corresponding the control signal set, a second node of the sixteenth transistor is coupled to the first voltage, a first node of the seventeenth transistor is coupled to the second node of the eleventh transistor, a gate node of the seventeenth transistor receives the first control signal of the corresponding control signal set, a second node of the seventeenth transistor is coupled to the fourth voltage, a first node of the eighteenth transistor is coupled to the second node of the ninth transistor, a gate node of the eighteenth transistor is coupled to the second node of the eleventh transistor, a second node of the eighteenth transistor is coupled to the third voltage, a first node of the nineteenth transistor is coupled to the second node of the ninth transistor, a gate node of the nineteenth transistor is coupled to the second node of the first transistor, a second node of the nineteenth transistor is coupled to the sixth voltage, a first node of the twentieth transistor is coupled to the second node of the ninth transistor, a gate node of the twentieth transistor receives the signal, a second node of the twentieth transistor is coupled to the second node of the nineteenth transistor, a first node of the first capacitor is coupled to the second node of the third transistor, a second node of the first capacitor is grounded, a first node of the second capacitor is coupled to the second node of the eleventh transistor, a second node of the second capacitor is grounded, a first node of the third capacitor is coupled to the second node of the first transistor, a second node of the third capacitor is grounded.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
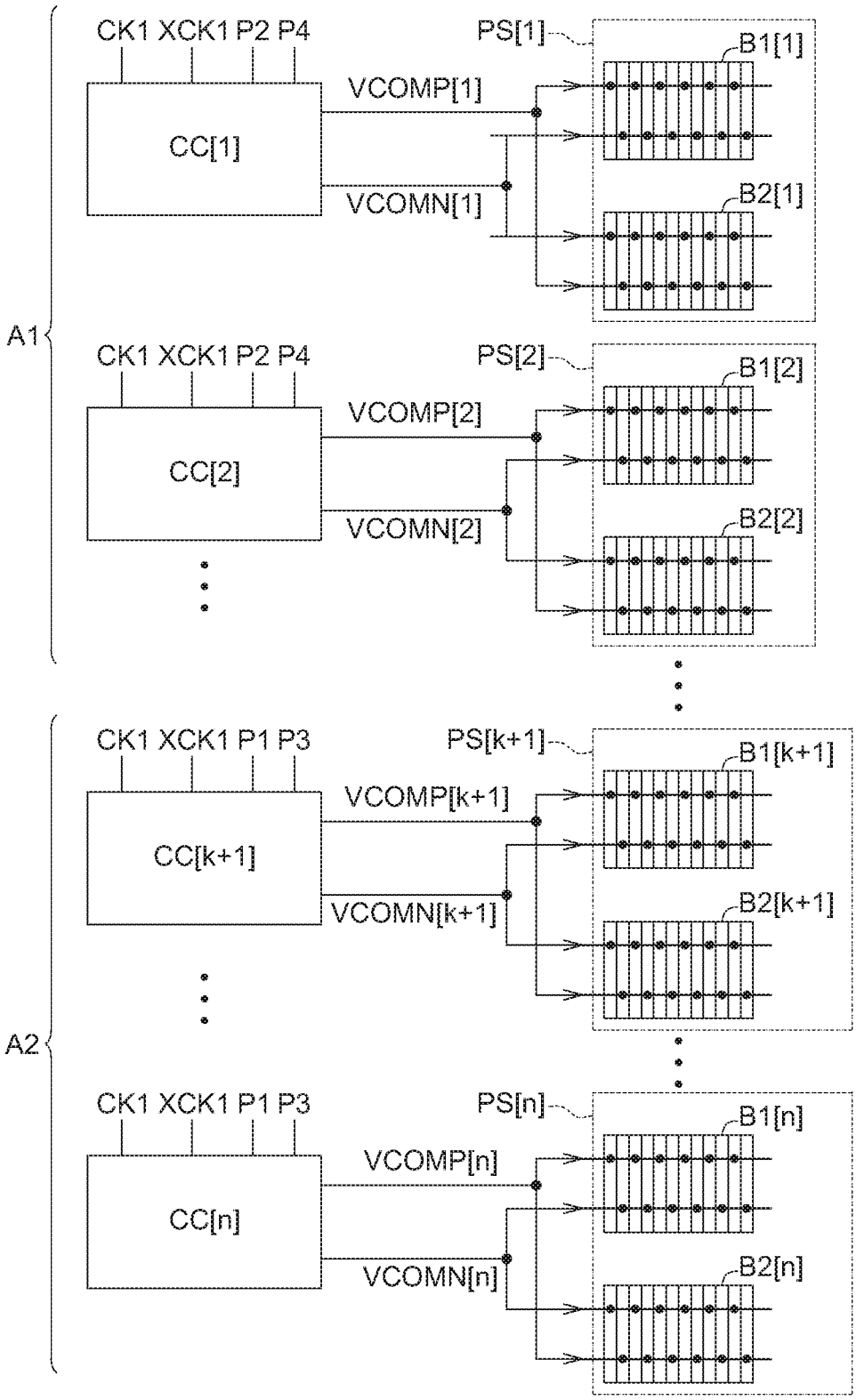
FIG. 1 shows a display device according to an embodiment of the present invention.

Referring to FIG. 1, FIG. 1 shows a display device according to an embodiment of the present invention. The display device 10 includes a plurality of pixel unit sets PS[1]~PS[n], a plurality of common electrode signal generation circuits (hereafter, VCOM signal generation circuit) CC[1]~CC[n], wherein n is a positive integer. Each of the pixel unit sets PS[1]~PS[n] include a first portion pixel units B1[1]~B1[*n*] and a second portion pixel units B2[1]~B2[*n*]. Each of the first portion pixel units B1[1]~B1[*n*] and each of the second portion pixel units B2[1]~B2[*n*] respectively includes a plurality row of pixel units, each row of the pixel units includes a plurality of pixel units. In this embodiment, each of the pixel unit sets includes sixteen rows of pixel units, each of the first portion pixel units includes eight rows of pixel units (only for illustration), and each of the second portion pixel units includes eight rows of pixel units. Each of the VCOM signal generation circuits CC[1]~CC[n] is coupled to one of the pixel unit sets PS[1]~PS[n]. For example, the VCOM signal generation circuit CC[1] is coupled to the pixel unit set PS[1], the VCOM signal generation circuit CC[2] is coupled to the pixel unit set PS[2], and so forth. The VCOM signal generation circuits CC[1]~CC[n] is divided into a first group A1 and a second group A2. Each of the VCOM signal generation circuits CC[1]~CC[k] in the first group A1 generates a first VCOM signals VCOMP[1]~VCOMP[k] and a second VCOM signals VCOMN[1]~VCOMN[k] according to a first clock signal CK1, a second clock signal XCK1, and a first control signal set P2, P4; each of the VCOM signal generation circuits CC[k+1]~CC[n] in the second group A2 generates a first VCOM signal VCOMP[k+1]~VCOMP[n] and a second VCOM signal VCOMN[k+1]~VCOMN[n] according to the first clock signal CK1, the second clock signal XCK1, and a second control signal set P1, P3, wherein k is a positive integer less than n. Each of the VCOM signal generation circuits CC[1]~CC[n] provides the generated first VCOM signal VCOMP[1]~VCOMP[n] to the pixel units on the odd columns of first portion pixel units B1[1]~B1[*n*] of the corresponding pixel unit set PS[1]~PS[n] and the pixel units on the even columns of the second portion pixel units B2[1]~B2[*n*] of the corresponding pixel unit set PS[1]~PS[n]; each of the VCOM signal generation circuits CC[1]~CC[n] provides the generated second VCOM signal VCOMN[1]~VCOMP[n] to the pixel units on the even columns of first portion pixel units B1[1]~B1[*n*] of the corresponding pixel unit set PS[1]~PS[n] and the pixel units on the odd columns of the second portion pixel units B2[1]~B2[*n*] of the corresponding pixel unit set PS[1]~PS[n]. Taking the pixel unit set PS[1] as an example, the VCOM signal generation circuit CC[1] provides the generated first VCOM signal VCOMP[1] to the pixel units on the odd columns such as the first, third, fifth columns (from the left) of the first portion pixel units B1[1] of the pixel unit set PS[1] and the pixel units on the even columns such as the second, fourth, sixth columns (from the left) of the second portion pixel units B2[1] of the pixel unit set PS[1], and provides the generated second VCOM signal VCOMN[1] to the pixel units on the even columns such as the second, fourth, sixth columns (from the left) of the first portion pixel units B1[1] of the pixel unit set PS[1] and the pixel units on the odd columns such as the first, third, fifth columns (from the left) of the second portion pixel units B2[1] of the pixel unit set PS[1].

Furthermore, display device 10 further includes a shift register (not shown) and a gate driving circuit (not shown). The gate driving circuit is coupled to the shift register and the pixel units. The shift register is configured to output a plurality of shift signals to the gate driving circuit. The gate driving circuit outputs a plurality of driving signals according to the shift signals to drive the pixel units row by row, to cause pixel data to be written into the driven pixel units.

Figure 2:
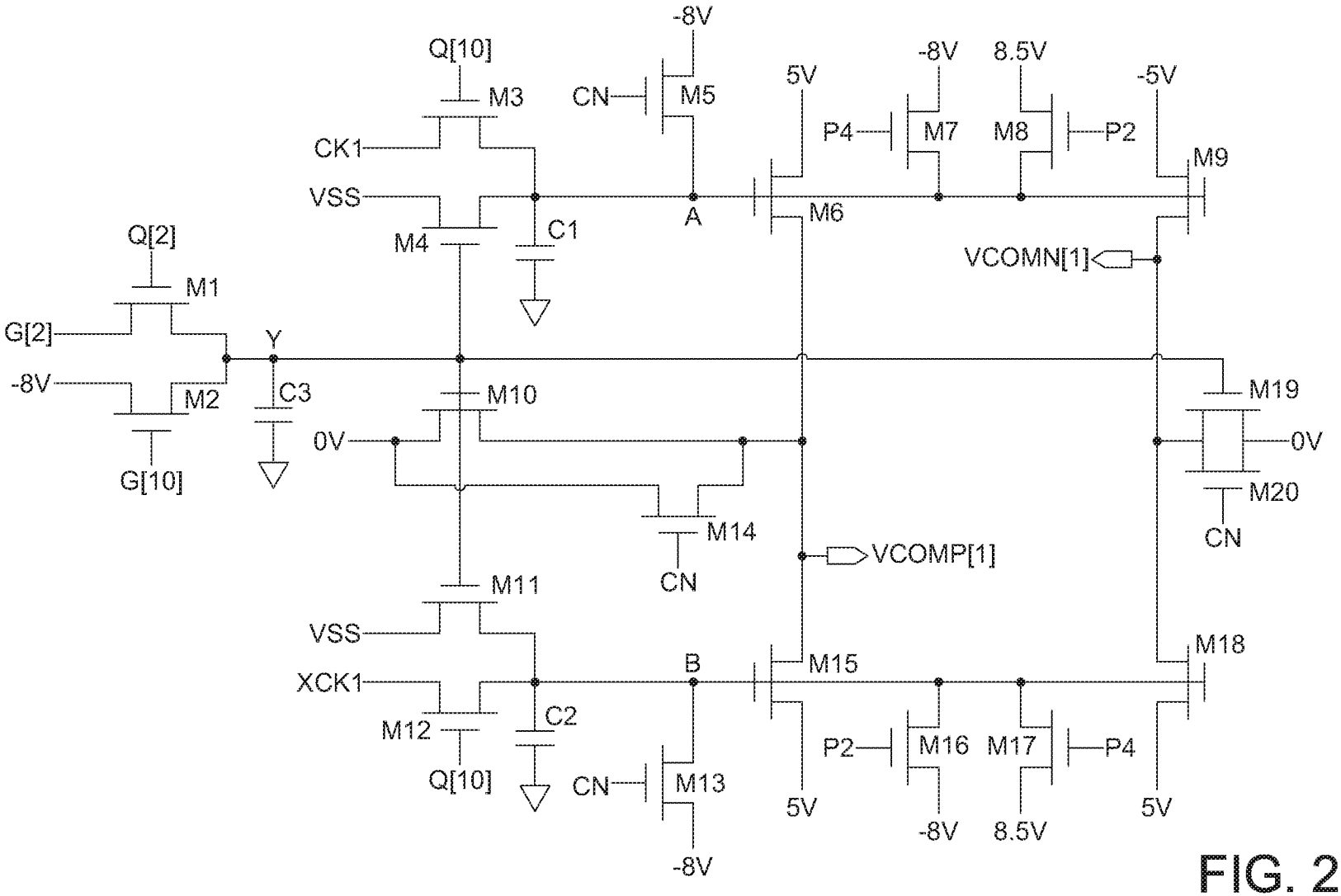
FIG. 2 shows a VCOM signal generation circuit according to an embodiment of the present invention.

Referring to FIG. 2, FIG. 2 shows a VCOM signal generation circuit according to an embodiment of the present invention. The VCOM signal generation circuit 20 may be used to implement the VCOM signal generation circuit CC[1] coupled to pixel unit set PS[1] in the display device 10. The VCOM signal generation circuit 20 includes a first transistor M1, a second transistor M2, a third transistor M3, a fourth transistor M4, a fifth transistor M5, a sixth transistor M6, a seventh transistor M7, an eighth transistor M8, a ninth transistor M9, a tenth transistor M10, an eleventh transistor M11, a twelfth transistor M12, a thirteenth transistor M13, a fourteenth transistor M14, a fifteenth transistor M15, a sixteenth transistor M16, a seventeenth transistor M17, an eighteenth transistor M18, a nineteenth transistor M19, a twentieth transistor M20, a first capacitor C1, a second capacitor C2 and a third capacitor C3.

A first node of the first transistor M1 receives a first shift signal G[2] output by the shift register. A gate node of the first transistor M1 receives a first driving signal Q[2] output by the gate driving circuit. A first node of the second transistor M2 is coupled to a first voltage (−8V). A gate node of the second transistor M2 receives a second shift signal G[10] output by the shift register. A second node of the second transistor M2 is coupled to a second node of the first transistor M1. A first node of the third transistor M3 receives the first clock signal CK1. A gate node of the third transistor M3 receives a second driving signal Q[10] output by the gate driving circuit. A first node of the fourth transistor M4 is coupled to a second voltage VSS. A gate node of the fourth transistor M4 is coupled to the second node of the first transistor M1. A second node of the fourth transistor M4 is coupled to a second node of the third transistor M3. A first node of the fifth transistor M5 is coupled to the first voltage (−8V). A gate node of the fifth transistor M5 is coupled to a signal CN. A second node of the fifth transistor M5 is coupled to the second node of the third transistor M3. A first node of the sixth transistor M6 is coupled to a third voltage (5V). A gate node of the sixth transistor M6 is coupled to the second node of the third transistor M3. A second node of the sixth transistor M6 is configured to output the first VCOM signal VCOMP[1]. A first node of the seventh transistor M7 is coupled to the first voltage (−8V). A gate node of the seventh transistor M7 receives a first control signal P4 of the first control signal set. A second node of the seventh transistor M7 is coupled to the second node of the third transistor M3. A first node of the eighth transistor M8 is coupled to a fourth voltage (8.5V). A gate node of the eighth transistor M8 receives a second control signal P2 of the first control signal set. A second node of the eighth transistor M8 is coupled to the second node of the third transistor M3. A first node of the ninth transistor M9 is coupled to a fifth voltage (−5V). A gate node of the ninth transistor M9 is coupled to the second node of the third transistor M3. A second node of the ninth transistor M9 is configured to output the second VCOM signal VCOMN[1]. A first node of the tenth transistor M10 is coupled to a sixth voltage (0V). A gate node of the tenth transistor M10 is coupled to the second node of the first transistor M1. A second node of the tenth transistor M10 is coupled to the second node of the sixth transistor M6. A first node of the eleventh transistor M11 is coupled to the third voltage VSS. A gate node of the eleventh transistor M11 is coupled to the second node of the first transistor M1. A first node of the twelfth transistor M12 receives the second clock signal XCK1. A gate node of the twelfth transistor M12 receives the second driving signal Q[10]. A second node of the twelfth transistor M12 is coupled to a second node of the eleventh transistor M11. A first node of the thirteenth transistor M13 is coupled to the second node of the eleventh transistor M11. Agate node of the thirteenth transistor M13 receives the signal CN. A second node of the thirteenth transistor M13 is coupled to the first voltage (−8V). A first node of the fourteenth transistor M14 is coupled to the first node of the tenth transistor M10. A gate node of the fourteenth transistor M14 receives the signal CN. A second node of the fourteenth transistor M14 is coupled to the second node of the sixth transistor M6. A first node of the fifteenth transistor M15 is coupled to the second node of the sixth transistor M6. Agate node of the fifteenth transistor M15 is coupled to the second node of the eleventh transistor M11. A second node of the fifteenth transistor M15 is coupled to the fifth voltage (−5V). A first node of the sixteenth transistor M16 is coupled to the second node of the eleventh transistor M11. A gate node of the sixteenth transistor M16 receives the second control signal P2 of the first control signal set. A second node of the sixteenth transistor M16 is coupled to the first voltage (−8V). A first node of the seventeenth transistor M17 is coupled to the second node of the eleventh transistor M11. A gate node of the seventeenth transistor M17 receives the first control signal P4 of the first control signal set. A second node of the seventeenth transistor M17 is coupled to the fourth voltage (8.5V). A first node of the eighteenth transistor M18 is coupled to the second node of the ninth transistor M9. A gate node of the eighteenth transistor M18 is coupled to the second node of the eleventh transistor M11. A second node of the eighteenth transistor M18 is coupled to the third voltage (5V). A first node of the nineteenth transistor M19 is coupled to the second node of the ninth transistor M9. A gate node of the nineteenth transistor M19 is coupled to the second node of the first transistor M1. A second node of the nineteenth transistor M19 is coupled to the sixth voltage (0V). A first node of the twentieth transistor M20 is coupled to the second node of the ninth transistor M9. A gate node of the twentieth transistor M20 receives the signal CN. A second node of the twentieth transistor M20 is coupled to the second node of the nineteenth transistor M19. A first node of the first capacitor C1 is coupled to the second node of the third transistor M3. A second node of the first capacitor C1 is grounded. A first node of the second capacitor C2 is coupled to the second node of the eleventh transistor M11. A second node of the second capacitor C2 is grounded. A first node of the third capacitor C3 is coupled to the second node of the first transistor M1. A second node of the third capacitor C3 is grounded.

Figure 3:
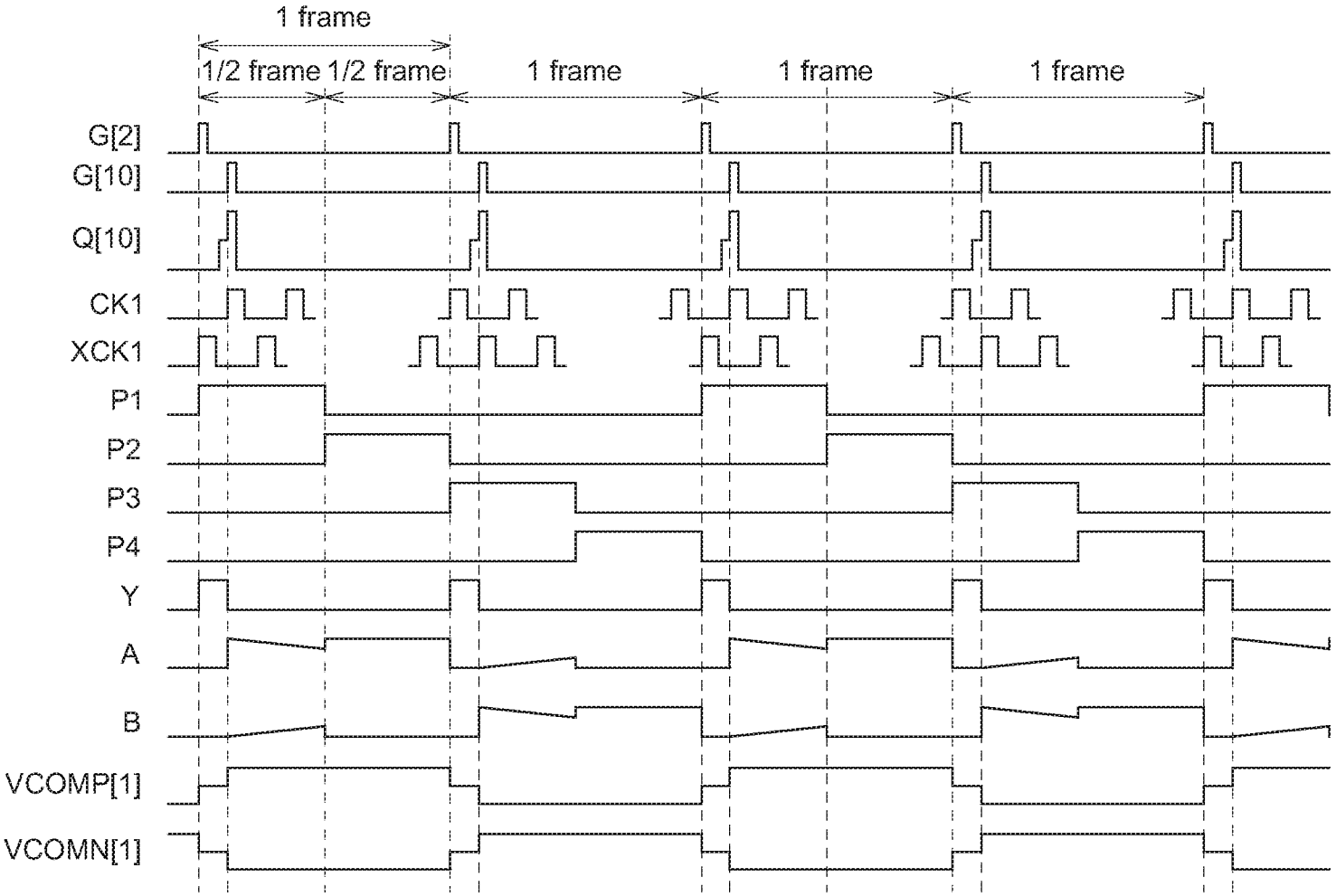
FIG. 3 shows a timing diagram according to an embodiment of the present invention.

To clearly illustrate the principle of the VCOM signal generation circuit 20, please refer to the signal timing diagram shown in FIG. 3. The first clock signal CK1 and the second clock signal XCK1 are signals with opposite phases, that is, when the first clock signal CK1 is logical high (hereafter, high), the second clock signal XCK1 is logical low (hereafter, low), and when the second clock signal XCK1 is high, the first clock signal CK1 is low. Furthermore, the first clock signal CK1 and the second clock signal XCK1 may be inversed at the beginning of each frame. A "frame" refers to a time period that the display device 10 displays one screen frame. The signal CN is a signal used for switching the display device 10 between a narrow view mode and a wide view mode, wherein when the signal CN is low, the display device 10 is switched to the narrow view mode which has a smaller viewing angle (i.e., privacy protected function); when the signal CN is high, the display device 10 is switched to the wild view mode which has a larger viewing angle. The following illustration is for the operations under the narrow mode of the display device 10, therefore the signal CN is set to low. The first clock signal CK1 and the second clock signal XCK1 may be provided by a driver IC. The first VCOM signal VCOMP[1] and the second VCOM signal VCOMN[1] have a first voltage level, a second voltage level and a third voltage level, wherein the first voltage level is lower than the second voltage level, and the second voltage level is lower than the third voltage level. During a period that the pixel data is going to be written into the pixel units of the pixel unit set PS[1] (i.e., corresponding to each of the frames, a period starting from the timing that the first shift signal G[2] changes from low to high to the timing that the second shift signal G[10] changes from low to high, hereafter, pixel data writing time), The first VCOM signal VCOMP[1] and the second VCOM signal VCOMN [1] are at the second voltage level (i.e., DC level). When the pixel data writing time of the corresponding pixel unit set PS[1] is over, the first VCOM signal VCOMP[1] may change from the second voltage level to and keep at the third voltage level, and the second VCOM signal VCOMN[1] may change from the second voltage level to and keep at the first voltage level, until the beginning of the next pixel data writing time. During the next pixel data writing time, the first VCOM signal VCOMP[1] and the second VCOM signal VCOMN[1] change to and keep at the second voltage level. When the next pixel data writing time is over, the first VCOM signal VCOMP[1] changes to and keeps at the first voltage level, and the second VCOM signal VCOMN[1]

changes to and keeps at the third voltage level, until the beginning of the pixel data writing time next the next pixel data writing time. That is, a period of the first VCOM signal VCOMP[1] and a period of the second VCOM signal VCOMN[1] are two frames. A period of the first control signal set P2, P4 and a period of the second control signal set P1, P3 are two frames. Each of the first control signal P4, the second control signal P2 of the first control signal set and the first control signal P1, the second control signal P3 of the second control signal set has a high level for a half of the frame during the two frames without overlapping to each other. When the first control signal P4 of the first control signal set is high, the first capacitor C1 may be charged by the first voltage (−8V), the second capacitor C2 may be charged by the fourth voltage (8.5V). When the second control signal P2 of the first control signal set is high, the first capacitor C1 may be charged by the fourth voltage (8.5V), the second capacitor C2 may be charged by the first voltage (−8V). By the above-described approach, the voltages at node A and B may be maintained at the desired voltages, so that the VCOM signal generation circuit CC[1] may be able to provide the first VCOM signal VCOMP[1] and the second VCOM signal VCOMN[1] correctly.

After appropriate modification, the VCOM signal generation circuit 20 may be used for implementing the odd stages such as the VCOM signal generation circuits CC[3], CC[5] of the first group A1. The detail may be described below. The node(s) configured to receive the first shift signal G[2] is modified to receive the shift signal corresponding to the beginning of the pixel data writing time of the coupled pixel unit set (e.g., PS[3], PS[5]). The node(s) configured to receive the second shift signal G[10] is modified to receive the shift signal corresponding to the ending of the pixel data writing time of the coupled pixel unit set (e.g., PS[3], PS[5]). The node(s) configured to receive the first driving signal Q[2] is modified to receive the driving signal corresponding to the beginning of the pixel data writing time of the coupled pixel unit set (e.g., PS[3], PS[5]). The node(s) configured to receive the second driving signal Q[10] is modified to receive the driving signal corresponding to the ending of the pixel data writing time of the coupled pixel unit set (e.g., PS[3], PS[5]). Taking the VCOM signal generation circuit CC[3] as an example, the shift signal and the driving signal corresponding to the beginning of the pixel data period of the pixel unit set PS[3] coupled to the VCOM signal generation circuit CC[3] are G[18], Q[18], respectively, the shift signal and the driving signal corresponding to the ending of the pixel data period of the pixel unit set PS[3] coupled to the VCOM signal generation circuit CC[3] are G[26], Q[26], respectively. That is, while the nodes of the VCOM signal generation circuit 20 which are configured to respectively receive G[2], Q[2], G[10], Q[10] are modified to respectively receive G[18], Q[18], G[26], Q[26], the VCOM signal generation circuit CC[3] may be implemented.

After appropriate modification, the VCOM signal generation circuit 20 may be used for implementing the even stages such as the VCOM signal generation circuits CC[2], CC[4] of the first group A1. The detail may be described below. The node(s) configured to receive the first shift signal G[2] is modified to receive the shift signal corresponding to the beginning of the pixel data writing time of the coupled pixel unit set (e.g., PS[2], PS[4]). The node(s) configured to receive the second shift signal G[10] is modified to receive the shift signal corresponding to the ending of the pixel data writing time of the coupled pixel unit set (e.g., PS[2], PS[4]). The node(s) configured to receive the first driving signal Q[2] is modified to receive the driving signal corresponding to the beginning of the pixel data writing time of the coupled pixel unit set (e.g., PS[2], PS[4]). The node(s) configured to receive the second driving signal Q[10] is modified to receive the driving signal corresponding to the ending of the pixel data writing time of the coupled pixel unit set (e.g., PS[2], PS[4]). The node(s) configured to receive the first control signal P4 of the first control signal set is modified to receive the second control signal P2 of the first control signal set. The node(s) configured to receive the second control signal P2 of the first control signal set is modified to receive the first control signal P4 of the first control signal set. Taking the VCOM signal generation circuit CC[2] as an example, the shift signal and the driving signal corresponding to the beginning of the pixel data period of the pixel unit set PS[2] coupled to the VCOM signal generation circuit CC[2] are G[10], Q[10], respectively, the shift signal and the driving signal corresponding to the ending of the pixel data period of the pixel unit set PS[2] coupled to the VCOM signal generation circuit CC[2] are G[18], Q[18], respectively. That is, while the nodes of the VCOM signal generation circuit 20 which are configured to respectively receive G[2], Q[2], G[10], Q[10], P4, P2 are modified to respectively receive G[10], Q[10], G[18], Q[18], P2, P4, the VCOM signal generation circuit CC[2] may be implemented.

After appropriate modification, the VCOM signal generation circuit 20 may be used for implementing the odd stages of the VCOM signal generation circuits of the second group A2. The detail may be described below. For the VCOM signal generation circuit CC[k], assuming that k is an positive integer and an odd number, the shift signal and the driving signal corresponding to the beginning of the pixel data writing time of the pixel unit set PS[k] coupled to the VCOM signal generation circuit CC[k] are G[k+2], Q[k+2], respectively. The shift signal and the driving signal corresponding to the ending of the pixel data writing time of the pixel unit set PS[k] coupled to the VCOM signal generation circuit CC[k] are G[k+10], Q[k+10], respectively. That is, while the nodes of the VCOM signal generation circuit 20 which are configured to respectively receive G[2], Q[2], G[10], Q[10], P4, P2 are modified to respectively receive G[k+2], Q[k+2], G[k+10], Q[k+10], P3, P1, the VCOM signal generation circuit CC[k] may be implemented.

After appropriate modification, the VCOM signal generation circuit 20 may be used for implementing the even stages of the VCOM signal generation circuits of the second group A2. The detail may be described below. For the VCOM signal generation circuit CC[k], assuming that k is an positive integer and an even number, the shift signal and the driving signal corresponding to the beginning of the pixel data writing time of the pixel unit set PS[k] coupled to the VCOM signal generation circuit CC[k] are G[k+2], Q[k+2], respectively. The shift signal and the driving signal corresponding to the ending of the pixel data writing time of the pixel unit set PS[k] coupled to the VCOM signal generation circuit CC[k] are G[k+10], Q[k+10], respectively. That is, while the nodes of the VCOM signal generation circuit 20 which are configured to respectively receive G[2], Q[2], G[10], Q[10], P4, P2 are modified to respectively receive G[k+2], Q[k+2], G[k+10], Q[k+10], P1, P3, the VCOM signal generation circuit CC[k] may be implemented.

By the above-described approach, the holding times of the first capacitor C1 and the second capacitor C2 in each of the VCOM signal generation circuit CC[1]~CC[n] may be reduced to a maximum of one-half (i.e., ½).

Figure 4:
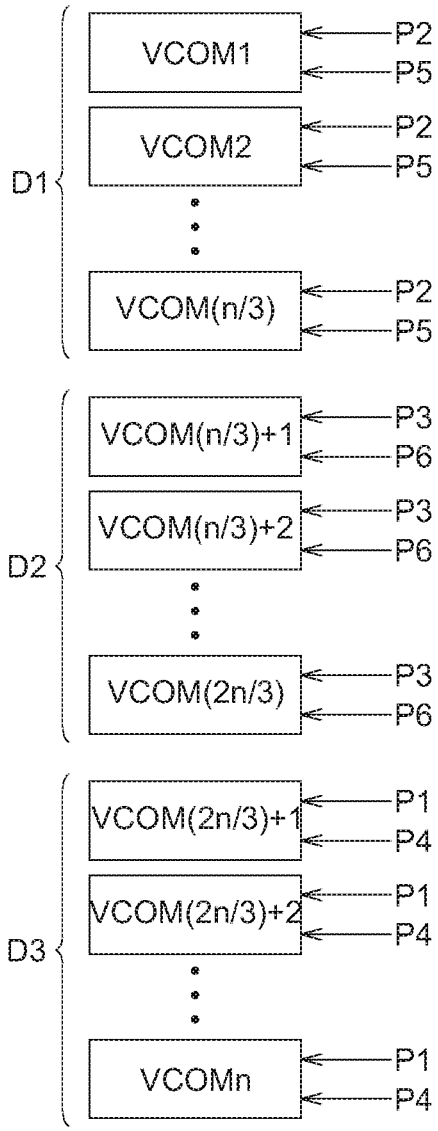
FIG. 4 shows grouping of a VCOM signal generation circuit according to an embodiment of the present invention.
Figure 5:
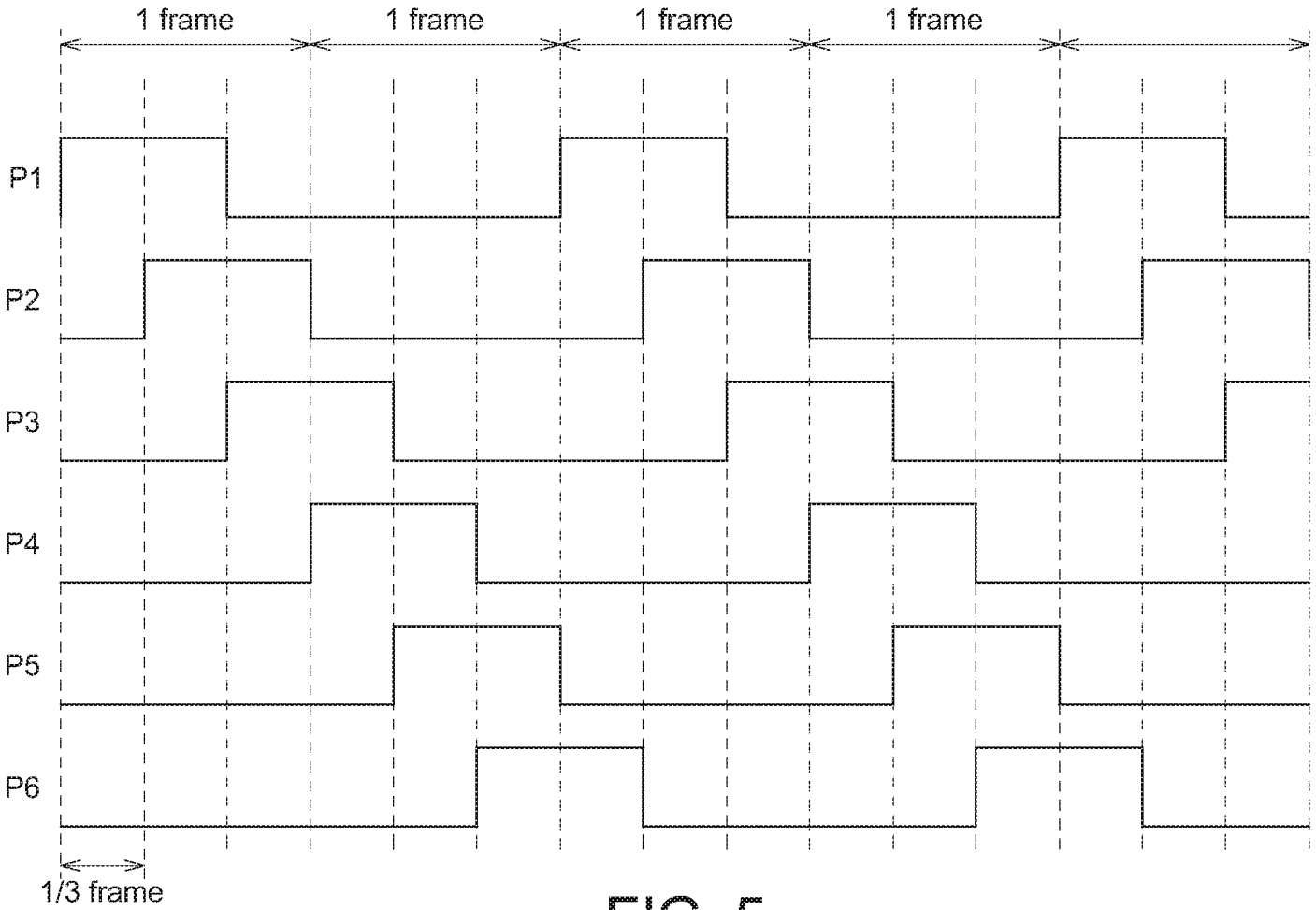
FIG. 5 shows a waveform diagram of a control signal set according to an embodiment of the present invention.

Referring to FIG. 4, FIG. 4 shows grouping of a VCOM signal generation circuit according to an embodiment of the present invention. In the configuration of FIG. 4, a plurality of VCOM signal generation circuits VCOM1~VCOMn of the display device are divided into a first group D1, a second group D2 and a third group D3. The VCOM signal generation circuits VCOM1~VCOM(n/3) of the first group D1 generate a first VCOM signal and a second VCOM signal according to a first control signal set P2, P5. The VCOM signal generation circuits VCOM(n/3+1)~VCOM(2n/3) of the second group D2 generate the first VCOM signal and the second VCOM signal according to second control signal set P3, P6. The VCOM signal generation circuits VCOM(2n/3+1)~VCOMn of the third group D3 generate the first VCOM signal and the second VCOM signal according to a third control signal set P1, P4. The waveform of the first control signal set P2, P5, the second control signal set P3, P6 and the third control signal set P1, P4 are shown in FIG. 5. The periods of control signals P1~P6 are two frames, and each of the control signal P1~P6 has a high level for two-thirds of the frame during one period, wherein the time period that each of the control signals is at the high level has one-third of the frame overlap with the time period that another control signal is at the high level, and does not overlap with the time period that the other four control signals are at the high level.

By the above-described approach, the holding times of the first capacitor C1 and the second capacitor C2 in each of the VCOM signal generation circuit CC[1]~CC[n] may be reduced to a maximum of one-third (i.e., ⅓).

Based on the above description and circuit architectures, it may be further derived that when the VCOM signal generation circuit is divided into groups of number m, and control signal sets of number m are employed (control signals of number 2m in total) for controlling, the holding time of the first capacitor and the second capacitor in each of the VCOM signal generation circuit may be reduced to a maximum of 1/m, wherein m is an integer greater than 1.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display device, comprising:

a plurality of pixel unit sets, each of the pixel unit sets comprising a first portion pixel unit and a second portion pixel unit, each of the first portion pixel unit and each of the second portion pixel unit comprising a plurality rows of pixel units, each row of the pixel units comprising a plurality of pixel units; and a plurality of common electrode (VCOM) signal generation circuits, respectively coupled to one of the pixel unit sets, wherein the VCOM signal generation circuits are divided into a plurality of groups of number m, the VCOM signal generation circuits in each of the groups generate a first VCOM signal and a second VCOM signal to the coupled pixel unit set according to a first clock signal, a second clock signal and one of a plurality control signal sets of number m, and m is an integer greater than 1; and wherein m is 2, each of the control signal sets comprises two control signals, the control signals have periods of two frames, and each of the control signals has a high level for one-half of the frame during one single period without overlap with the other.

2. The display device according to claim 1, wherein each of the VCOM signal generation circuits provides the generated first VCOM signal to the pixel units on a plurality of odd columns of the first portion pixel unit and the pixel units on a plurality of even columns of the second portion pixel unit in the coupled pixel unit set; and each of the VCOM signal generation circuits provides the generated second VCOM signal to the pixel units on a plurality of even columns of the first portion pixel unit and the pixel units on a plurality of odd columns of the second portion pixel unit in the coupled pixel unit set.

3. The display device according to claim 1, wherein when the first clock signal is a high voltage level, the second clock signal is a low voltage level, when the second clock signal is the high voltage level, the first clock signal is the low voltage level, and the first clock signal and the second clock signal are inversed at a beginning of each of a plurality frames.

4. The display device according to claim 1, wherein the first VCOM signal and the second VCOM signal of each of the VCOM signal generation circuits have periods of two frames, and have a first voltage level, a second voltage level and a third voltage level, the first voltage level is lower than the second voltage level, and the second voltage level is lower than the third voltage level; during a pixel data writing time of the pixel unit set coupled to each of the VCOM signal generation circuits, the first VCOM signal and the second VCOM signal are at the second voltage level, when the pixel data writing time is over, the first VCOM signal changes from the second voltage level to the third voltage level, the second VCOM signal changes from the second voltage level to the first voltage level, when a next pixel data writing time begins, the first VCOM signal and the second VCOM signal change to the second voltage level, when the next pixel data writing time is over, the first VCOM signal changes to the first voltage level, and the second VCOM signal changes to the third voltage level.

5. The display device according to claim 1, wherein each of the VCOM signal generation circuit comprises a first transistor, a second transistor, a third transistor, a fourth transistor, a fifth transistor, a sixth transistor, a seventh transistor, an eighth transistor, a ninth transistor, a tenth transistor, an eleventh transistor, a twelfth transistor, a thirteenth transistor, a fourteenth transistor, a fifteenth transistor, a sixteenth transistor, a seventeenth transistor, an eighteenth transistor, a nineteenth transistor, a twentieth transistor, a first capacitor, a second capacitor and a third capacitor, a first node of the first transistor receives a first shift signal corresponding to the beginning of a pixel data writing time of the pixel unit set coupled to each of the VCOM signal generation circuits output by a shift register, a gate node of the first transistor receives a gate driving circuit a first driving signal corresponding to the first shift signal, a first node of the second transistor is coupled to a first voltage, a gate node of the second transistor receives a second shift signal corresponding to the ending of the pixel data writing time of the pixel unit set coupled to each of the VCOM signal generation circuits output by the shift register, a second node of the second transistor is coupled to a second node of the first transistor, a first node of the third transistor receives the first clock signal, a gate node of the third transistor receives a second driving signal corresponding to the second shift signal output by the gate driving circuit, a first node of the fourth transistor is coupled to a second voltage, a gate node of the fourth transistor is coupled to the second node of the first transistor, a second node of the fourth transistor is coupled to a second node of the third transistor, a first node of the fifth transistor is coupled to the first voltage, a gate node of the fifth transistor is coupled to a signal, a second node of the fifth transistor is coupled to the second node of the third transistor, a first node of the sixth transistor is coupled to a third voltage, a gate node of the sixth transistor is coupled to the second node of the third transistor, a second node of the sixth transistor is configured to output the first VCOM signal, a first node of the seventh transistor is coupled to the first voltage, a gate node of the seventh transistor receives a first control signal of the corresponding control signal set, a second node of the seventh transistor is coupled to the second node of the third transistor, a first node of the eighth transistor is coupled to a fourth voltage, a gate node of the eighth transistor receives a second control signal of the corresponding control signal set, a second node of the eighth transistor is coupled to the second node of the third transistor, a first node of the ninth transistor is coupled to a fifth voltage, a gate node of the ninth transistor is coupled to the second node of the third transistor, a second node of the ninth transistor is configured to output the second VCOM signal, a first node of the tenth transistor is coupled to a sixth voltage, a gate node of the tenth transistor is coupled to the second node of the first transistor, a second node of the tenth transistor is coupled to the second node of the sixth transistor, a first node of the eleventh transistor is coupled to the third voltage, a gate node of the eleventh transistor is coupled to the second node of the first transistor, a first node of the twelfth transistor receives the second clock signal, a gate node of the twelfth transistor receives the second driving signal, a second node of the twelfth transistor is coupled to a second node of the eleventh transistor, a first node of the thirteenth transistor is coupled to the second node of the eleventh transistor, a gate node of the thirteenth transistor receives the signal, a second node of the thirteenth transistor is coupled to the first voltage, a first node of the fourteenth transistor is coupled to the first node of the tenth transistor, a gate node of the fourteenth transistor receives the signal, a second node of the fourteenth transistor is coupled to the second node of the sixth transistor, a first node of the fifteenth transistor is coupled to the second node of the sixth transistor, a gate node of the fifteenth transistor is coupled to the second node of the eleventh transistor, a second node of the fifteenth transistor is coupled to the fifth voltage, a first node of the sixteenth transistor is coupled to the second node of the eleventh transistor, a gate node of the sixteenth transistor receives the second control signal of the corresponding the control signal set, a second node of the sixteenth transistor is coupled to the first voltage, a first node of the seventeenth transistor is coupled to the second node of the eleventh transistor, a gate node of the seventeenth transistor receives the first control signal of the corresponding control signal set, a second node of the seventeenth transistor is coupled to the fourth voltage, a first node of the eighteenth transistor is coupled to the second node of the ninth transistor, a gate node of the eighteenth transistor is coupled to the second node of the eleventh transistor, a second node of the eighteenth transistor is coupled to the third voltage, a first node of the nineteenth transistor is coupled to the second node of the ninth transistor, a gate node of the nineteenth transistor is coupled to the second node of the first transistor, a second node of the nineteenth transistor is coupled to the sixth voltage, a first node of the twentieth transistor is coupled to the second node of the ninth transistor, a gate node of the twentieth transistor receives the signal, a second node of the twentieth transistor is coupled to the second node of the nineteenth transistor, a first node of the first capacitor is coupled to the second node of the third transistor, a second node of the first capacitor is grounded, a first node of the second capacitor is coupled to the second node of the eleventh transistor, a second node of the second capacitor is grounded, a first node of the third capacitor is coupled to the second node of the first transistor, a second node of the third capacitor is grounded.

6. A display device, comprising:

a plurality of pixel unit sets, each of the pixel unit sets comprising a first portion pixel unit and a second portion pixel unit, each of the first portion pixel unit and each of the second portion pixel unit comprising a plurality rows of pixel units, each row of the pixel units comprising a plurality of pixel units; and a plurality of common electrode (VCOM) signal generation circuits, respectively coupled to one of the pixel unit sets, wherein the VCOM signal generation circuits are divided into a plurality of groups of number m, the VCOM signal generation circuits in each of the groups generate a first VCOM signal and a second VCOM signal to the coupled pixel unit set according to a first clock signal, a second clock signal and one of a plurality control signal sets of number m, and m is an integer greater than 1; and wherein m is 3, each of the control signal sets comprises two control signals, the control signals have periods of two frames, each of the control signals has a high level for two-thirds of the frame during one single period, and the time period that each of the control signals is at the high level has one-third of the frame overlapping with the time period that another control signal is at the high level, and does not overlap with the time period that the other four control signals are at the high level.

7. A common electrode (VCOM) signal generation circuit for display devices, comprising:

a first transistor, a second transistor, a third transistor, a fourth transistor, a fifth transistor, a sixth transistor, a seventh transistor, an eighth transistor, a ninth transistor, a tenth transistor, an eleventh transistor, a twelfth transistor, a thirteenth transistor, a fourteenth transistor, a fifteenth transistor, a sixteenth transistor, a seventeenth transistor, an eighteenth transistor, a nineteenth transistor, a twentieth transistor, a first capacitor, a second capacitor and a third capacitor, wherein a first node of the first transistor receives a first shift signal corresponding to the beginning of a pixel data writing time of a pixel unit set coupled to each of the VCOM signal generation circuits output by a shift register, a gate node of the first transistor receives a gate driving circuit a first driving signal corresponding to the first shift signal, a first node of the second transistor is coupled to a first voltage, a gate node of the second transistor receives a second shift signal corresponding to the ending of the pixel data writing time of the pixel unit set coupled to each of the VCOM signal generation circuits output by the shift register, a second node of the second transistor is coupled to a second node of the first transistor, a first node of the third transistor receives the first clock signal, a gate node of the third transistor receives a second driving signal corresponding to the second shift signal output by the gate driving circuit, a first node of the fourth transistor is coupled to a second voltage, a gate node of the fourth transistor is coupled to the second node of the first transistor, a second node of the fourth transistor is coupled to a second node of the third transistor, a first node of the fifth transistor is coupled to the first voltage, a gate node of the fifth transistor is coupled to a signal, a second node of the fifth transistor is coupled to the second node of the third transistor, a first node of the sixth transistor is coupled to a third voltage, a gate node of the sixth transistor is coupled to the second node of the third transistor, a second node of the sixth transistor is configured to output the first VCOM signal, a first node of the seventh transistor is coupled to the first voltage, a gate node of the seventh transistor receives a first control signal of the corresponding control signal set, a second node of the seventh transistor is coupled to the second node of the third transistor, a first node of the eighth transistor is coupled to a fourth voltage, a gate node of the eighth transistor receives a second control signal of the corresponding control signal set, a second node of the eighth transistor is coupled to the second node of the third transistor, a first node of the ninth transistor is coupled to a fifth voltage, a gate node of the ninth transistor is coupled to the second node of the third transistor, a second node of the ninth transistor is configured to output the second VCOM signal, a first node of the tenth transistor is coupled to a sixth voltage, a gate node of the tenth transistor is coupled to the second node of the first transistor, a second node of the tenth transistor is coupled to the second node of the sixth transistor, a first node of the eleventh transistor is coupled to the third voltage, a gate node of the eleventh transistor is coupled to the second node of the first transistor, a first node of the twelfth transistor receives the second clock signal, a gate node of the twelfth transistor receives the second driving signal, a second node of the twelfth transistor is coupled to a second node of the eleventh transistor, a first node of the thirteenth transistor is coupled to the second node of the eleventh transistor, a gate node of the thirteenth transistor receives the signal, a second node of the thirteenth transistor is coupled to the first voltage, a first node of the fourteenth transistor is coupled to the first node of the tenth transistor, a gate node of the fourteenth transistor receives the signal, a second node of the fourteenth transistor is coupled to the second node of the sixth transistor, a first node of the fifteenth transistor is coupled to the second node of the sixth transistor, a gate node of the fifteenth transistor is coupled to the second node of the eleventh transistor, a second node of the fifteenth transistor is coupled to the fifth voltage, a first node of the sixteenth transistor is coupled to the second node of the eleventh transistor, a gate node of the sixteenth transistor receives the second control signal of the corresponding the control signal set, a second node of the sixteenth transistor is coupled to the first voltage, a first node of the seventeenth transistor is coupled to the second node of the eleventh transistor, a gate node of the seventeenth transistor receives the first control signal of the corresponding control signal set, a second node of the seventeenth transistor is coupled to the fourth voltage, a first node of the eighteenth transistor is coupled to the second node of the ninth transistor, a gate node of the eighteenth transistor is coupled to the second node of the eleventh transistor, a second node of the eighteenth transistor is coupled to the third voltage, a first node of the nineteenth transistor is coupled to the second node of the ninth transistor, a gate node of the nineteenth transistor is coupled to the second node of the first transistor, a second node of the nineteenth transistor is coupled to the sixth voltage, a first node of the twentieth transistor is coupled to the second node of the ninth transistor, a gate node of the twentieth transistor receives the signal, a second node of the twentieth transistor is coupled to the second node of the nineteenth transistor, a first node of the first capacitor is coupled to the second node of the third transistor, a second node of the first capacitor is grounded, a first node of the second capacitor is coupled to the second node of the eleventh transistor, a second node of the second capacitor is grounded, a first node of the third capacitor is coupled to the second node of the first transistor, a second node of the third capacitor is grounded.

8. The VCOM signal generation circuit according to claim 7, wherein when the first clock signal is a high voltage level, the second clock signal is a low voltage level, when the second clock signal is the high voltage level, the first clock signal is the low voltage level, and the first clock signal and the second clock signal are inversed at a beginning of each of a plurality frames.

9. The VCOM signal generation circuit according to claim 7, wherein the first VCOM signal and the second VCOM signal have periods of two frames, and have a first voltage level, a second voltage level and a third voltage level, the first voltage level is lower than the second voltage level, and the second voltage level is lower than the third voltage level; during the pixel data writing time of the pixel unit set coupled to the VCOM signal generation circuits, the first VCOM signal and the second VCOM signal are at the second voltage level, when the pixel data writing time is over, the first VCOM signal changes from the second voltage level to the third voltage level, the second VCOM signal changes from the second voltage level to the first voltage level, when a next pixel data writing time begins, the first VCOM signal and the second VCOM signal change to the second voltage level, when the next pixel data writing time is over, the first VCOM signal changes to the first voltage level, and the second VCOM signal changes to the third voltage level.

* * * * *